US005957072A

United States Patent [19]

Hattori

[11] Patent Number: 5,957,072

[45] Date of Patent: Sep. 28, 1999

[54] AIR-INTAKE SYSTEM FOR WATERCRAFT

[75] Inventor: Toshiyuki Hattori, Shizuoka, Japan

[73] Assignee: Yamaha Hatsudoki Kabushiki Kaisha, Japan

[21] Appl. No.: 08/920,793

[22] Filed: Aug. 29, 1997

[30] Foreign Application Priority Data

Aug. 29, 1996 [JP] Japan ..... 8-228665

[51] Int. Cl.[6] ..... B63B 35/00

[52] U.S. Cl. ..... 114/55.57; 440/88; 440/89

[58] Field of Search ..... 440/88, 89; 114/270

[56] References Cited

U.S. PATENT DOCUMENTS

| | | | |
|---|---|---|---|
| 3,982,497 | 9/1976 | Caron | 114/270 |
| 4,568,293 | 2/1986 | Yazaki | 114/211 |
| 4,753,199 | 6/1988 | Melde-Tuczai et al. | 123/90.31 |
| 4,982,682 | 1/1991 | Hattori | 114/270 |
| 4,984,528 | 1/1991 | Kobayashi . | |
| 5,049,100 | 9/1991 | Yamamoto et al. . | |
| 5,237,950 | 8/1993 | Abe et al. . | |
| 5,340,344 | 8/1994 | Mineo et al. . | |
| 5,390,621 | 2/1995 | Hattori et al. . | |
| 5,490,474 | 2/1996 | Ikeda . | |
| 5,511,505 | 4/1996 | Kobayashi et al. . | |
| 5,558,549 | 9/1996 | Nakase et al. | 114/270 |
| 5,562,509 | 10/1996 | Nakase et al. | 440/89 |
| 5,582,125 | 12/1996 | Matsumoto | 114/270 |
| 5,586,922 | 12/1996 | Kobayashi et al. . | |
| 5,634,832 | 6/1997 | Nakase et al. . | |
| 5,664,515 | 9/1997 | Hattori et al. . | |
| 5,743,206 | 4/1998 | Hattori . | |

*Primary Examiner*—Jesus D. Sotelo

*Attorney, Agent, or Firm*—Knobbe, Martens, Olson & Bear, LLP

[57] ABSTRACT

An improved air-intake system and engine layout for use on a small watercraft provides for a lower temperature, vapor fuel/air charge with less water vapor content. The watercraft includes an engine-air intake system incorporating an air-intake box which inhibits the engine from intaking water present in the engine compartment, especially during high speed maneuvering. An extended flywheel case is also provided that prevents water located in the engine compartment from being sprayed by moving parts directly into the air-intake box. Furthermore, the improved air-intake system of the present invention incorporates external air-intake valves that prevent water from entering the engine and propulsion compartments through the air intakes while the watercraft is in an inverted.

29 Claims, 14 Drawing Sheets

AIR-INTAKE SYSTEM FOR WATERCRAFT

BACKGROUND OF THE INVENTION

1. Field of the Invention

This invention relates to the field of small watercraft and, more particularly, to an improved air-intake system for use on a small watercraft.

2. Description of Related Art

Personal watercraft have become increasingly popular in recent years. This type of watercraft is sporting in nature; it turns swiftly, maneuvers easily, and accelerates quickly. A personal watercraft today commonly carries one rider and possibly one or two passengers.

A relatively small hull of the personal watercraft, comprising an upper deck and a lower hull, commonly defines a riders' area above an engine compartment. An internal combustion engine frequently powers a jet propulsion unit which is positioned in a tunnel formed on the underside of the watercraft hull. The propulsion unit propels the watercraft. The engine lies within the engine compartment, below the riders' area. An exhaust system extends between the engine and a discharge opening to expel exhaust gases either to the atmosphere or to the water. The exhaust system usually includes a water trap device that inhibits a reverse flow of water through the exhaust system from the discharge opening toward the engine.

It has become commonplace for small watercraft, such as for example, personal watercraft, to be operated in virtually any water condition, including ocean surf. Due to the design of the engine-air path, it is often possible for such small watercraft to operate for short periods of time submerged or in a substantially non-vertically oriented position. By drawing its air supply from the internal engine compartment of the small watercraft, these small watercraft engines are generally able to avoid periodic interruptions in the engine-air supply occasioned by waves or other rough weather conditions submerging the external air intakes.

SUMMARY OF THE INVENTION

The present invention includes the recognition that prior layout of the engine and exhaust components in the watercraft's engine compartment can lead to reduced engine performance under some operating conditions. One such instance is when a significant amount of water fills the engine compartment. Where the small watercraft experiences extremely rough water conditions such as ocean surf, maneuvers sharply at high speeds, a significant amount of water can quickly flow through the air ducts into the engine compartment of the watercraft. This influx of water, combined with the water already present inside the engine compartment of the watercraft, can possibly submerge or splash into the air-intake(s) of the watercraft engine. Furthermore, this trapped water will often contact various moving parts of the engine, such as a coupling between the engine's crankshaft and the impeller shaft, which will cause further splashing of water in the engine compartment. Where water enters the air-intake(s), this water will become entrained in the fuel/air change delivered to the engine's cylinders, which can cause the engine to lose power, sputter, stall, or, in extreme conditions, possibly damage the engine components.

While it is possible to reduce the amount of water present in the engine compartment through the use of additional bilge pumps or special hull designs, such solutions increase the number and weight of components in the small watercraft and/or may minimize the cooling-air flow through the engine compartment. In addition, it is extremely difficult to remove all water from the engine compartment. A need therefore exists for a device that reduces the possibility of a small watercraft engine intaking water in the engine compartment during rough water conditions and/or high speed maneuvers.

In addition, the exhaust system of the engine can become quite hot after extended periods of watercraft operation. The heat from the exhaust system, and in particular, from the water trap, which usually functions also as an expansion chamber or muffler, heats the surrounding air in the engine compartment. When the engine intakes the heated air, a fuel/air ratio of the produced fuel/air charge does not correspond to a desired fuel/air ratio because the heated intake air has less oxygen per given volume than normal. Engine performance consequently suffers. Accordingly, a need exists for inhibiting a flow of air within the engine compartment from the space surrounding the water trap to the engine's induction system.

In accordance with one aspect of the present invention there is provided an improved intake system for use with a small watercraft engine located within the engine compartment of a small watercraft. The intake system comprises an air-intake box connected to the air-intake pipes of an engine located within the engine compartment of a small watercraft. The air intake box incorporates valves which serve to isolate the air intake box from splashing water in the engine compartment, thereby preventing the small watercraft from intaking a substantial amount of water. This air-intake box also permits the engine to briefly operate while the entire air-intake box is submerged.

Another aspect of the present invention involves extending a portion of the flywheel case over the flywheel and crankshaft coupling. This extension will redirect any water spray caused by the moving crankshaft coupling, thereby preventing such spray from entering the air-intake and being ingested by the engine. The extension also acts as a heat insulator, reducing the ambient heat level in the engine compartment near the air-intake system and inhibiting air flow from about this heated exhaust system with trap to the air-intake system.

Another aspect of the present invention involves the positioning of the engine in the engine compartment of the small watercraft. In one embodiment, the engine is tilted approximately 10 degrees towards the engine exhaust side of the engine, thereby raising the air-intakes of the engine above the air-exhausts. This orientation allows an air-intake box of the present invention to be attached to a standard small watercraft engine without substantially changing the air-intake/exhaust components and/or hull design.

In another aspect of the present invention is provided an improved valve design for use on the external hull of the watercraft, which prevents water from entering the engine and/or propulsion chamber through the intake-air ducts when the watercraft is inverted or in a substantially non-vertical orientation. This is accomplished by providing buoyant closures in air duct valves which are normally open but, when submerged, operate to close the air ducts and prevent water from traveling through the duct. Once the watercraft is returned to its substantially upright position, the buoyant closures reopen the air duct, returning air flow to the engine.

Further aspects, features and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft. The illustrated embodiments are intended to illustrate, but not to limit the invention. The drawings contain the following figures.

DETAILED DESCRIPTION OF THE PREFERRED EMBODIMENT

Figure 1:
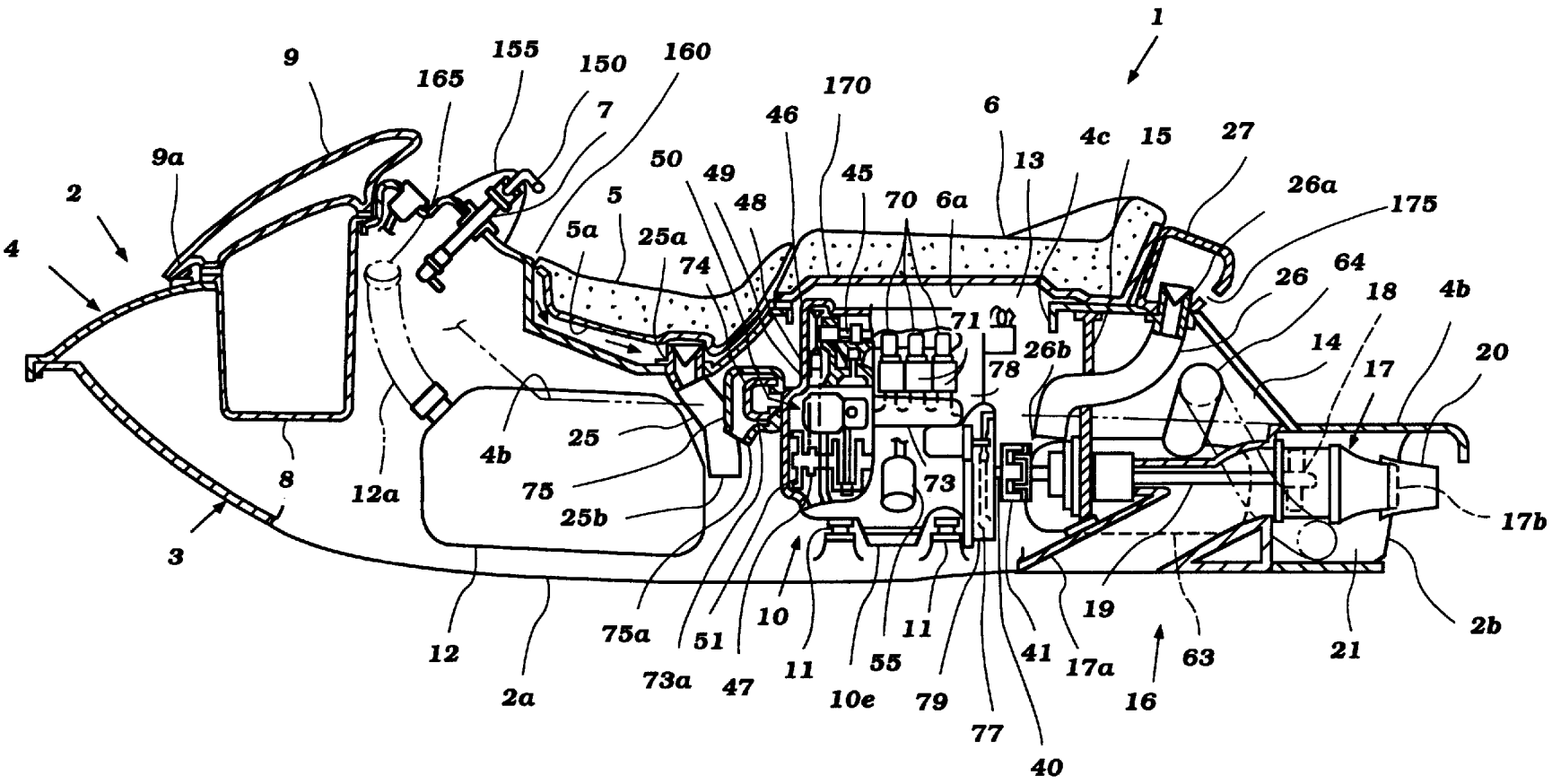
FIG. 1 is a longitudinal cross-sectional side view of a small watercraft in accordance with preferred embodiment of the present invention.
Figure 2:
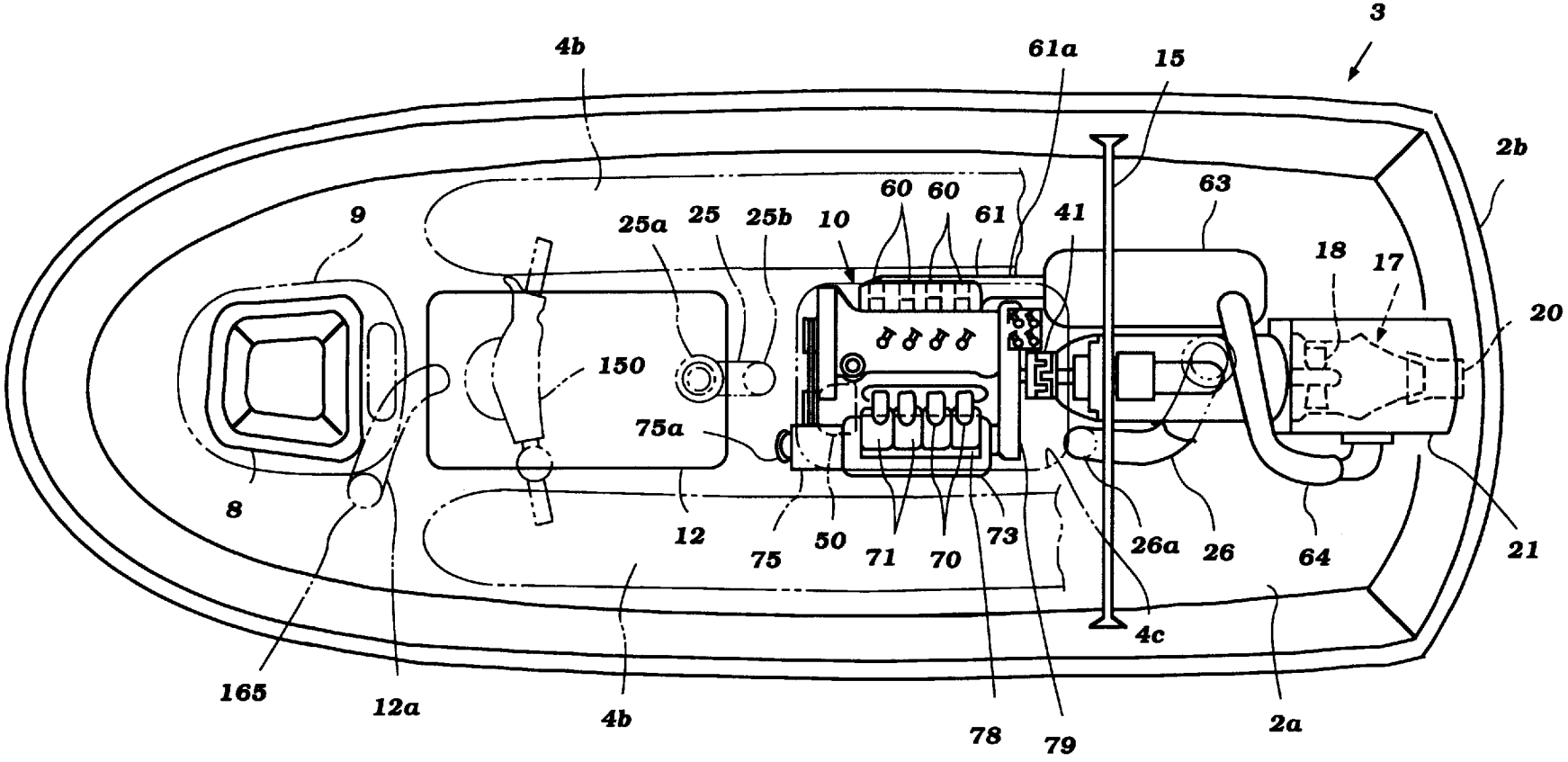
FIG. 2 is a sectional, top plan view of the small watercraft of FIG. 1 with portions of the components as an upper deck shown in phantom.
Figure 3:
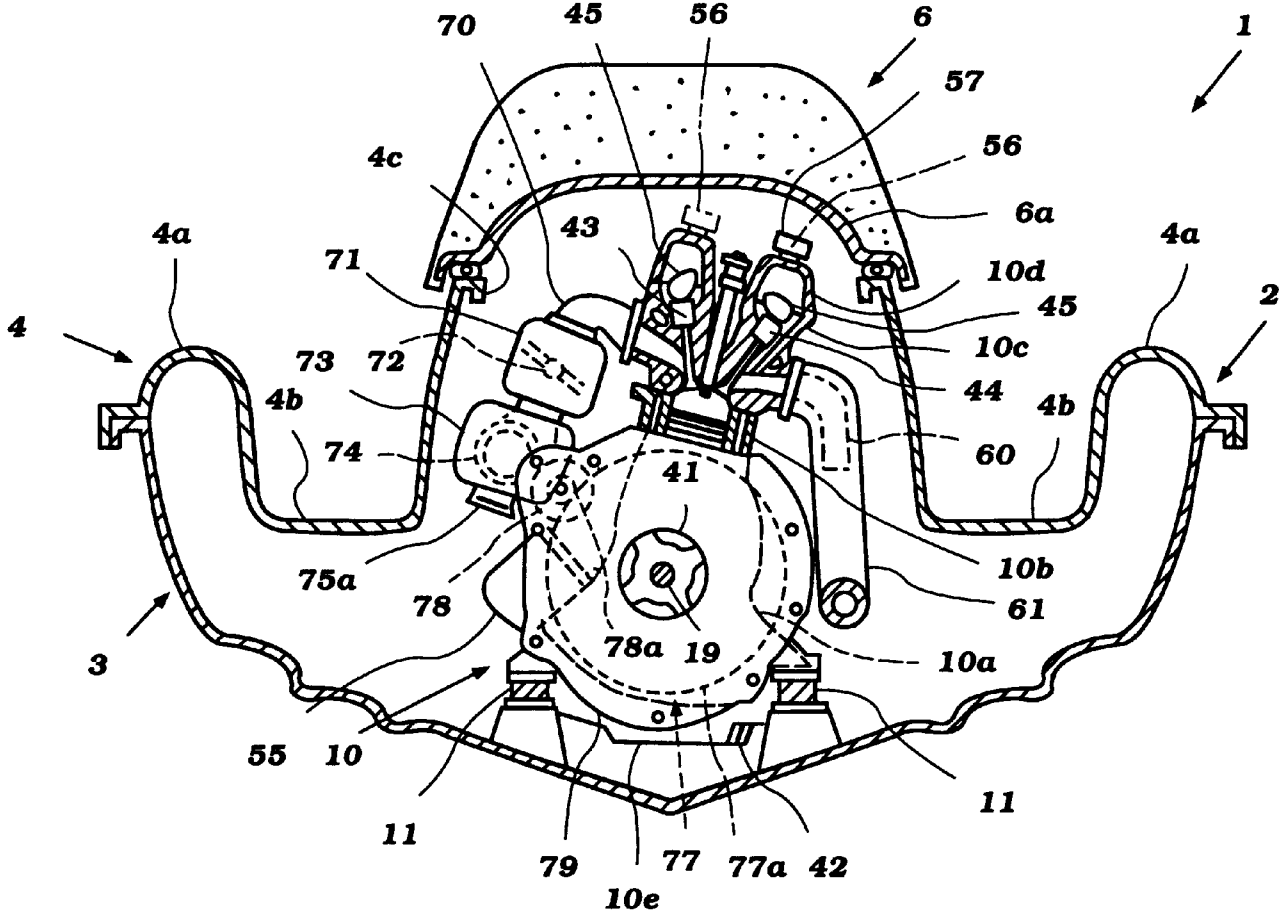
FIG. 3 is a lateral cross-sectional view of the small watercraft of FIG. 1.

FIGS. 1 through 3 illustrate different views of a small watercraft incorporating an air intake box and engine arrangement configured in accordance with a preferred embodiment of the present invention. While the present invention has particular utility with a small watercraft having an engine located within the engine compartment of the small watercraft, some aspects of the present invention have equal utility with watercraft utilizing external-hull air intakes or externally mounted engines. As such, the invention will be described with the small watercraft design in this context; however, it is understood that the present invention may also be employed on other types of watercraft.

The following description describes several embodiments of the present invention which include unique induction system construction and orientation within the engine compartment. Where appropriate, the same reference numerals have been used between the various embodiments to indicate like components. In addition, various aspects of the different embodiments can be incorporated into the other embodiments, as will be readily apparent to those skilled in the art.

With initial reference to FIGS. 1 through 3, a small watercraft, indicated generally by reference numeral 1, includes a hull 3 formed by a lower hull section 2*a* and upper deck section 4. These hull sections 2*a*, 4 are formed from a suitable material such as, for example, a molded fiberglass reinforced resin. For instance, the deck 4 and the hull 2*a* can be formed using a sheet molding compound (SMC), i.e. a mixed mass of reinforced fiber and thermal setting resin, that is processed in a pressurized, closed mold. The molding process desirably is temperature controlled such that the mold is heated and cooled during the molding process. For this purpose, male and female portions of the mold can include fluid jackets through which steam and cooling water can be run to heat and cool the mold during the manufacturing process. The lower hull section 2*a* and the upper deck section 4 are fixed to each other around the peripheral edges in any suitable manner commonly known to those skilled in the art.

As viewed in a direction from the bow to the stern of the watercraft, the upper deck section 4 includes a bow portion 2, a control mast 7, a front seat 5 and a rear seat 6. The bow portion 2 slopes upwardly toward the control mast 7 and includes at least one air duct 25 through which air can enter the hull 3.

The control mast 7 extends upward from the bow portion 2 and supports a handlebar assembly 150. The handlebar assembly 150 controls the steering of the watercraft in a conventional manner well known to those skilled in the art. The handlebar assembly also carries a variety of the controls of the watercraft such as, for example, a throttle control, a start switch and a lanyard switch. The handlebar assembly 150 is enclosed by a handle cover 155 and is pivotally provided in front of the front seat 5.

A hatch cover 9 is provided in front of the steering handle 7. The hatch cover 9 is secured to the upper deck 4 by a hinge 9*a*, and is able to open and close freely, thereby exposing the forward section of the interior of the hull 3. A latch (not shown) is provided to secure the hatch cover 9 in its closed position during operation of the watercraft 1. A storage box 8 is removably provided in the deck below the hatch cover 9. This storage box 8 is covered by the hatch cover 9 in a water sealing manner.

A forward air opening 160, located adjacent to the front seat 5, desirably allows ambient air traveling over the upper deck 4 to travel below the front bottom plate 5*a* of the front seat 5. This airflow then travels into an air inlet port 25*a*, located below the front seat 5, and into the air duct 25. A rearward air opening 175, located behind the rear seat 6, desirably allows ambient air to travel through cover 27, through air inlet port 26*a*, and into the rear-air duct 26.

The front and rear seats 5, 6 are desirably straddle-type seats having an elongated shape that extends along the longitudinal axis of the watercraft. These seats are centrally located between the sides of the hull and are mounted on front bottom plate 5*a* and rear bottom plate 6*a*, respectively. In the illustrated embodiment, the rear seat 6 is positioned at an elevated level relative to the front seat 5. This advantageously positions the riders at different levels.

A fuel tank 12 is located within the hull 3. A fuel supply pipe 12*a* extends from the surface of deck 4 to the fuel tank 12. Conventional means such as straps (not shown) secure the fuel tank to the lower hull 2*a*. In the illustrated embodiment, a filler cap assembly 165 is secured to the bow portion 2 of the hull upper deck 4. In this manner, the fuel tank 12 may be filled from outside the hull 3 with the fuel passing through the fuel supply pipe 12*a* into the tank 12.

A bulkhead 15 desirably is vertically provided behind the engine 10 and divides the hull 3 into an engine chamber or compartment 13 and a propulsion chamber 14. Air ducts 25, 26 for guiding air into the engine chamber 13, are provided in the forward/rear parts of the engine chamber 13. Air inlet ports 25*a*, 26*a* of each air duct 25, 26 are located in openings formed in the upper deck 4. Air-outlet ports 25*b*, 26*b* of each air duct are respectively opened to the forward and rear sides of the engine 10. These air outlet ports 25*b*, 26*b* are positioned lower than the engine intake-air system (to be described later) so as to prevent water flowing through the air ducts 25, 26 from traveling directly into the engine intake-air system. Although air is supplied to the engine compartment 13 though both ducts, a flow of air from the front duct to the rear duct also occurs to air cool the engine and the other components of the watercraft located in the engine compartment 13.

A jet propulsion unit, indicated generally by reference numeral 16, is provided in the pump chamber 21. This jet propulsion unit 16 includes an impeller shaft 19 to which an impeller 18 is fixed. The impeller shaft 19 is positioned in the longitudinal directions and extends through a propulsion duct 17 that has a water inlet port 17*a* positioned on the keel of the lower hull section 2*a*. The lower hull section 2*a* includes an opening at the stern 2*b* of the watercraft 1 in which a jet outlet port 17*b* of the propulsion unit 16 is positioned. A front end of the impeller shaft 18 and an output shaft 40 (e.g., a crankshaft) of the engine are coupled through a conventional shock-absorbing coupling 41 to transfer power from the crankshaft to the impeller shaft. The propulsion unit 16 generates the propulsive force by applying pressure to water drawn up from the water inlet port 17*a* by means of the rotation of the impeller shaft 18, and forcing the pressurized water through the jet outlet port 17*b* in a manner well known to those skilled in the art.

A nozzle deflector or steering nozzle 20 is connected to the jet outlet port 17*b* of the propulsion unit 16. The nozzle deflector 20 desirably moves in the left/right and vertical directions via a known gimbal mechanism. The nozzle deflector 20 is connected to the handlebar assembly 150 through a steering mechanism and trim mechanism (not shown), whereby the steering and trim angles may be changed by the operation of the handlebar assembly 150 and associated trim controls.

The upper deck 4 of the watercraft includes a longitudinally extending pedestal 170, preferably formed as part of the upper deck 4. The pedestal 170 supports the front and rear seats 5, 6. Foot areas 4*b* are formed along side this pedestal 170, between the pedestal 170 and a pair of raised side gunnels or bulwarks 4*a* that extend along the outer sides of the watercraft 1. These foot areas 4*b* are sized to accommodate the lower legs and feet of the riders who straddle the front and rear seats 5, 6 when seated. In the illustrated embodiment, a deck 4*b*', formed at the rear of the watercraft behind the pedestal, extends above the propulsion unit 16 and allows ease of entry onto the watercraft 1, as is well known in the art.

A maintenance opening 4*c* is formed on the top surface of the seat pedestal 170 and is desirably positioned below the rear seat 6. This maintenance opening 4*c* is covered by the rear bottom plate 6*a* in a water-sealing manner. The engine chamber 13 can be accessed through this maintenance opening 4*c* by removing the rear seat 6.

An in-line, three-cylinder, four-cycle engine 10 is mounted in the center of the main body of the watercraft; however, other types of engines also can be used to power the watercraft. For instance, engines which have differing numbers of cylinders, use other cylinder arrangements or operate on other operating principles (e.g., two-stroke) can be used for this purpose.

The general construction of the four-stroke engine 10 is well known to those of ordinary skill in the art. As depicted in FIGS. 1 and 3, the engine 10 comprises cylinder block 10*b*, a cylinder head 10*c*, head covers 10*d*, and a crank case 10*a*. Intake valves 43 are disposed in the cylinder head 10*c* for controlling the delivery of a fuel/air mixture to the cylinders of the engine 10. Exhaust valves 44 are similarly disposed in the cylinder head 10*c* for controlling the expulsion of exhaust gases. Opening and closing of the intake and exhaust valves is regulated by the operation of the camshafts 45, the sprockets 46, 47, and the timing chain 48. The timing chain 48 is connected to the drive sprocket 47, and is enclosed by a cover 49 which protects the timing chain 48 and prevents accidental contact between a rider and the chain during maintenance of the engine 10.

Power from the crankshaft 40 is transferred to the impeller shaft 19 through the coupling 41. The crankshaft 40 also carries a flywheel 77 on the rear side of the engine 10. A starter motor 78 rotates the crankshaft 40 through a ring gear 77*a* formed on the periphery of the flywheel 77, and operates to start the engine in a manner well known to those of ordinary skill in the art. An alternator 50 is connected to the crankshaft 40. The alternator 50 converts the mechanical power created by the rotation of the crankshaft 40 into electrical power for the engine 10 and associated systems in a manner well known to those of ordinary skill in the art. For this purpose, a drive pulley 51 located on the front side of the engine 10 is attached to the crankshaft 40. A belt interconnects the drive pulley 51 to a pulley on the alternator 50 to drive the alternator in a known manner.

The flywheel 77, located within the flywheel case 79, is coupled to the crankshaft 40 to ensure smooth and even rotation of the crankshaft 40 during operation of the engine 10. The flywheel case 79 extends rearwardly, substantially surrounding the flywheel. In addition, this extension of the flywheel case 79 will prevent water in contact with rotating coupling 41 from spraying into the engine intake-air system (to be described later). Furthermore, the flywheel case 79 acts as an insulator between the air in the engine compartment forward of the flywheel case 79 and the air in the engine compartment behind the flywheel case 79. The case 79 also inhibits the airflow in the engine compartment in the forward direction, thereby limiting the heating of the engine intake-air system and the intake air.

On top of the engine 10 is a lubricating oil supply port 56, through which oil may be added to the engine 10. An oil cap 57 closes and seals this supply port 56, thereby preventing a loss of oil from the engine and ensuring that water does not contaminate the oil supply. An oil pan 10*e* is provided in the bottom of the engine 10. An oil filter 55, located adjacent to the oil pan 10*e*, is provided to continuously clean the engine oil. A drain plug 42 is provided in the oil pan 10*e* to facilitate removal of engine oil for maintenance.

On one side of the engine 10 an exhaust system is provided. In this exhaust system, exhaust runners 60 extend from the side of the engine and downward into an exhaust-air merging box 61. An exhaust-air merge pipe 61*a*, extending rearwardly from the exhaust-air merging box 61, connects to a front end of a water lock or trap 63. The water lock 63 inhibits a reverse flow of water toward the engine. In the rear end of the water lock 63, a through-hull exhaust pipe 64 is connected. This exhaust pipe 64 extends upwardly and across the hull and over the pump chamber, and is connected to a pump chamber of the watercraft to exhaust at this location. The outlet of the exhaust pipe 64 can also be located on the lower surface of the hull, on the transom of the hull or on the side of the hull.

The engine 10 desirably is oriented within the hull 3 to locate a crankshaft 40 of the engine 10 along a longitudinal axis of the main body. The engine 10 is mounted above the lower hull section 2*a* of the watercraft through a damper member or mount 11. As best depicted in FIG. 3, in one embodiment of the present invention the engine 10 is mounted such that the cylinder block 10*b* is skewed from vertical such that the axes of its cylinders are about by approximately 10 degrees off vertical. This engine orientation places the engine-air intake approximately 2 to 3 inches above the engine-air exhaust. This rotation permits an intake-air merging box 73 (to be described later) to be positioned in the intake air system without requiring substantial redesign of the intake system components, engine design and/or an increase in the cross-sectional width of the seat pedestal. Furthermore, the increased height of the engine-air intake allows the intake-air merging box 73 to be generally equally distanced from the upper deck and the lower deck of the small watercraft, a location that is least subject to water invasion during operation of the small watercraft.

The intake air system comprises fuel/air-intake pipes 70 connected to intake passage of the engine 10 which communicate with the engine's cylinders through the valve 43. The fuel/air intake pipes 70 also communicate with at least one charge former. In the illustrated embodiment, the opposite end of each intake pipe 70 is connected to carburetors 71. The carburetors 71 vaporize and mix fuel with the intake-air and regulate this fuel/air mixture using butterfly-type throttle valves 72 in a manner well known to those skilled in the art.

As best illustrated in FIGS. 1 and 3, the carburetors 71 are also connected to air intake pipes 70, which are in turn connected to an intake-air silencer 73. The intake-air silencer is connected to an air filter 74, which is in turn connected to the intake box 75. A trumpet-shaped air-inlet port 75*a* is disposed on the bottom surface of the intake box 75, which allows air to be drawn into the intake box 75 at a low velocity while inhibiting entrance of water. The intake box 75 is located on the front side of the engine with its opening facing down. Water entrained in the air flow desirably is separated in the intake box 75 and is drained through the downward opening 75*a*.

As best seen in FIG. 2, the case 79 of the flywheel 77 lies between the intake silencer 73, as well as the balance of the components of the induction system, and the watertrap 63 and the exhaust pipe 64. At this location, the casing 79 generally insulates, at least to some degree, the induction system from the heat radiated by the exhaust system, principally by the water trap 63 and the exhaust pipe 64. The casing also inhibits air from the rear of the engine compartment toward the intake opening 75*a*. The casing 79, as mentioned above, also generally shields the intake port 75*a* from water which may be splattered by the rotating coupling 41 and the associated shafts. As a result, the air entering into the intake box 75 generally contains less water vapor and is cooler than the air circulating about the rear end of the engine compartment.

Figure 4:
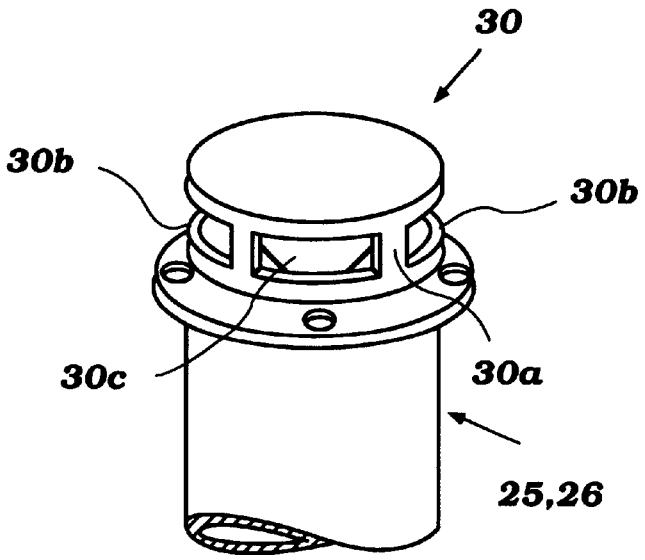
FIG. 4 is a side view of a rubber valve member construed in accordance with a preferred embodiment of the present invention.

FIG. 4 shows a rubber valve member 30 constructed in accordance with one embodiment of the present invention. This type of valve 30 is desirably disposed at the upper end of each axis inlet port 25*a*, 26*a* of the front and rear air ducts 25, 26.

Rubber valve member 30 is comprised of peripheral walls 30*a* and disc 30*c*. Air windows 30*b* are formed in the walls 30*a*. The lower section of the peripheral walls 30*a* encircles and is secured to an external projection of each air inlet port 25*a*, 26*a*. A flange 180, formed integral with and perpendicular to the air inlet port 25*a*, 26*a*, secures the air inlet port to the upper deck 4 of the watercraft 1. In the preferred embodiment, the peripheral walls 30*a* and disc 30*c* are formed of a buoyant, flexible material such as a low density foam rubber.

Figure 5:
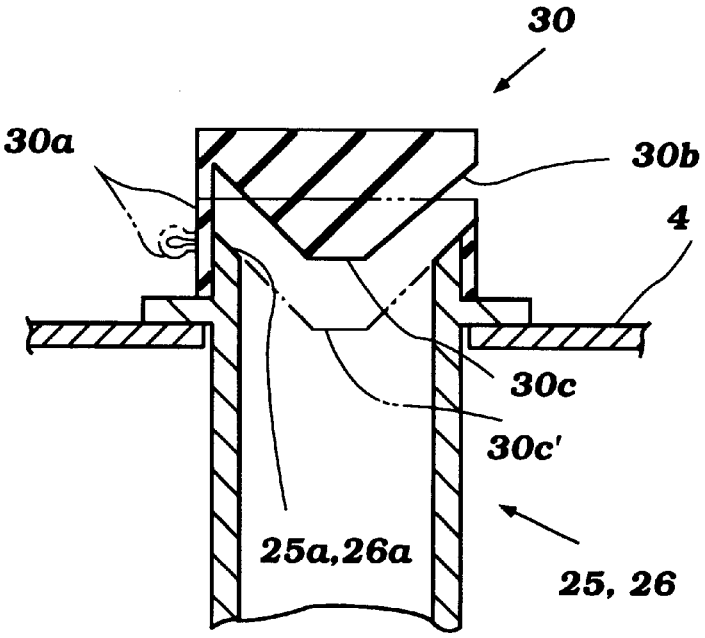
FIG. 5 is a cross-sectional side view of the rubber valve member of FIG. 4 with the valve illustrated in an open position and phantom lines illustrating a closed position.

As shown in FIG. 5, during normal operation, the disc 30*c* of the rubber valve member 30 is supported by the peripheral walls 30*a*, thereby allowing air to travel through the air windows and into the air ducts 25, 26. However, when the watercraft is inverted and the rubber valve member 30 is submerged, the natural buoyant forces acting on the disc 30*c* overcome the strength exerted by the peripheral walls 30*a*, thereby buckling the peripheral walls 30*a* and allowing the disc 30*c* to assume new position 30*c*', effectively sealing the air ducts 25, 26 and preventing further water from entering the watercraft. When the watercraft resumes its normal orientation, this buoyant force on the disc is removed, thereby allowing the spring force exerted by the peripheral walls 30*a* to lift the disc 30*c* into its normal operating position and resuming the flow of air into the air ducts 25, 26.

Figure 6:
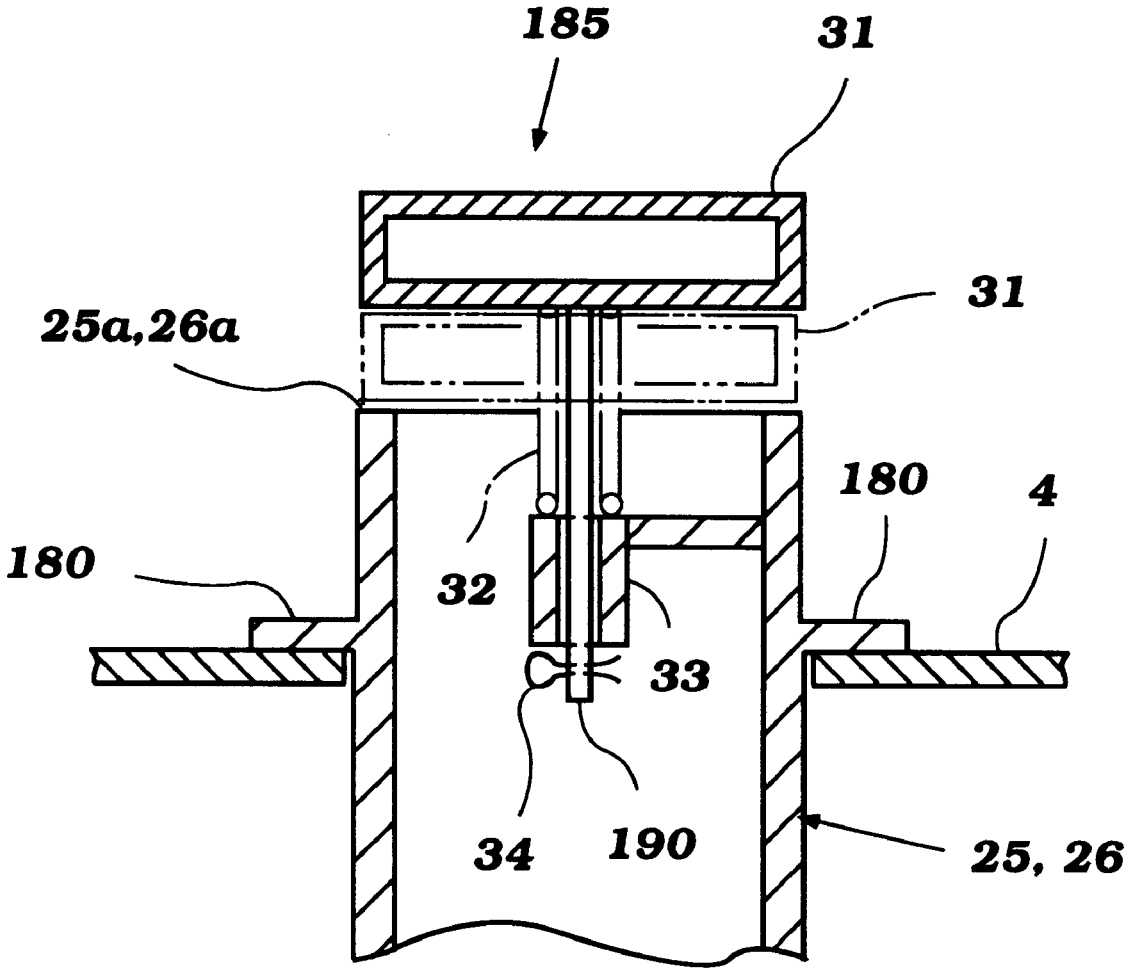
FIG. 6 is a cross-sectional side view of another embodiment of a rubber valve member constructed in accordance with the present invention.

FIG. 6 shows an alternate embodiment of a valve member constructed in accordance with the present invention. Spring valve 185 is comprised of buoyant block 31, spring valve shaft 190, spring 32, shaft support 33, and stopper pin 34. A flange 180, formed integral with and perpendicular to the air inlet port 25*a*, 26*a*, secures the air inlet port to the upper deck 4 of the watercraft 1. The shaft support is disposed within the respective air inlet port 25*a*, 26*a*.

During normal operation of the spring valve 185, the lower surface of the buoyant block 31 is held above the upper surface of the air inlet ports 25*a*, 26*a* by a force exerted by the spring 32, thus allowing air to travel into the corresponding air duct 25, 26. Vertical motion of the buoyant block is limited by the interaction of stopper pin 34 with the lower surface of the shaft support 33. When the watercraft is inverted and the spring valve 185 is submerged, however, buoyant forces acting on the buoyant block are greater than the force exerted by the spring, thereby allowing the buoyant block to travel towards and abut the air inlet ports 25*a*, 26*a*. This substantially seals the air inlet ports and prevents water from entering the engine compartment of the watercraft. When the watercraft resumes its normal orientation, the buoyant force on the buoyant block is removed, thereby allowing the force exerted by the spring to lift the buoyant block off of the air inlet port 25*a*, 26*a*, and resuming the flow of air into the corresponding air duct 25, 26.

Figure 7:
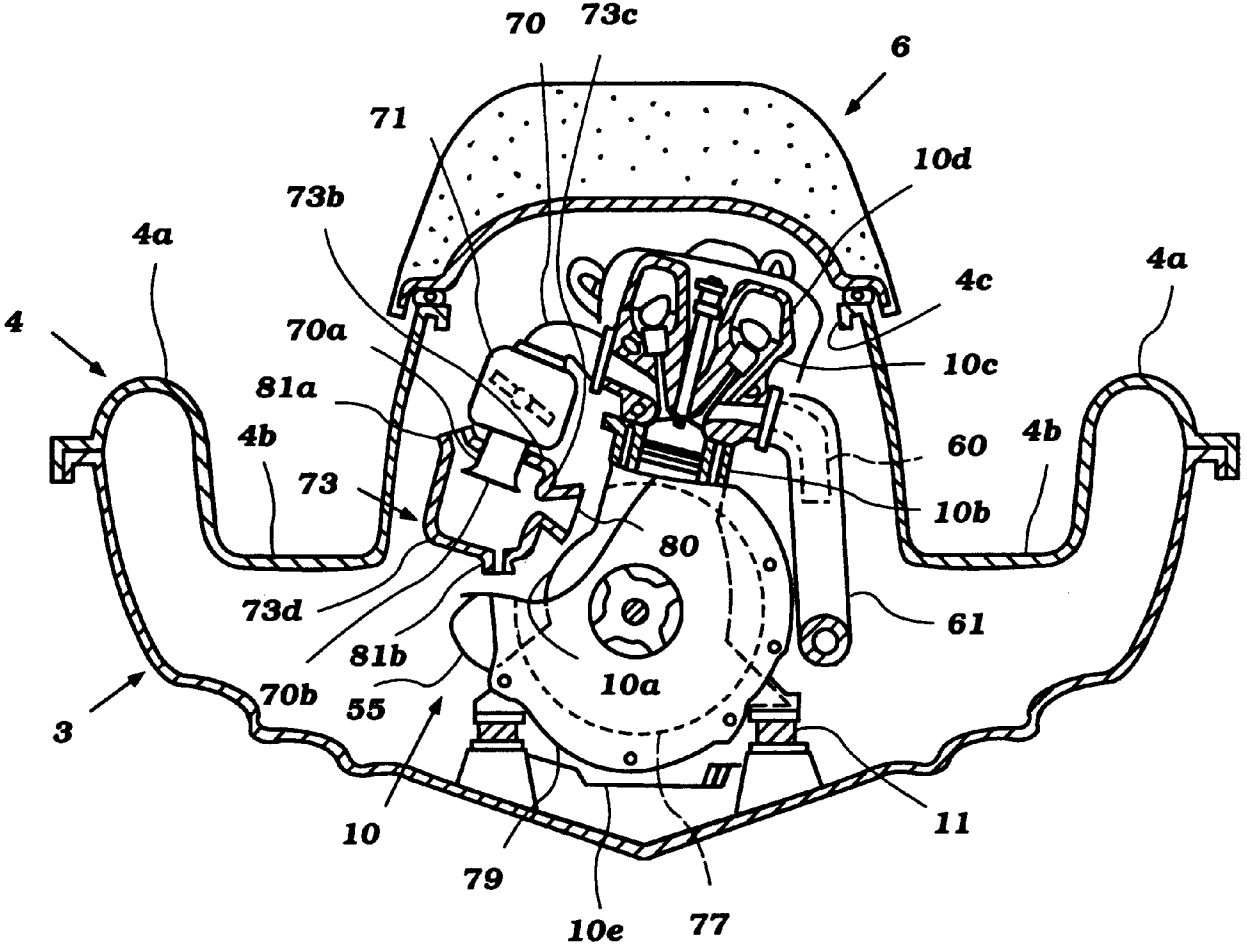
FIG. 7 is a cross-sectional rear view of a small watercraft incorporating another embodiment of the present invention.
Figure 8:
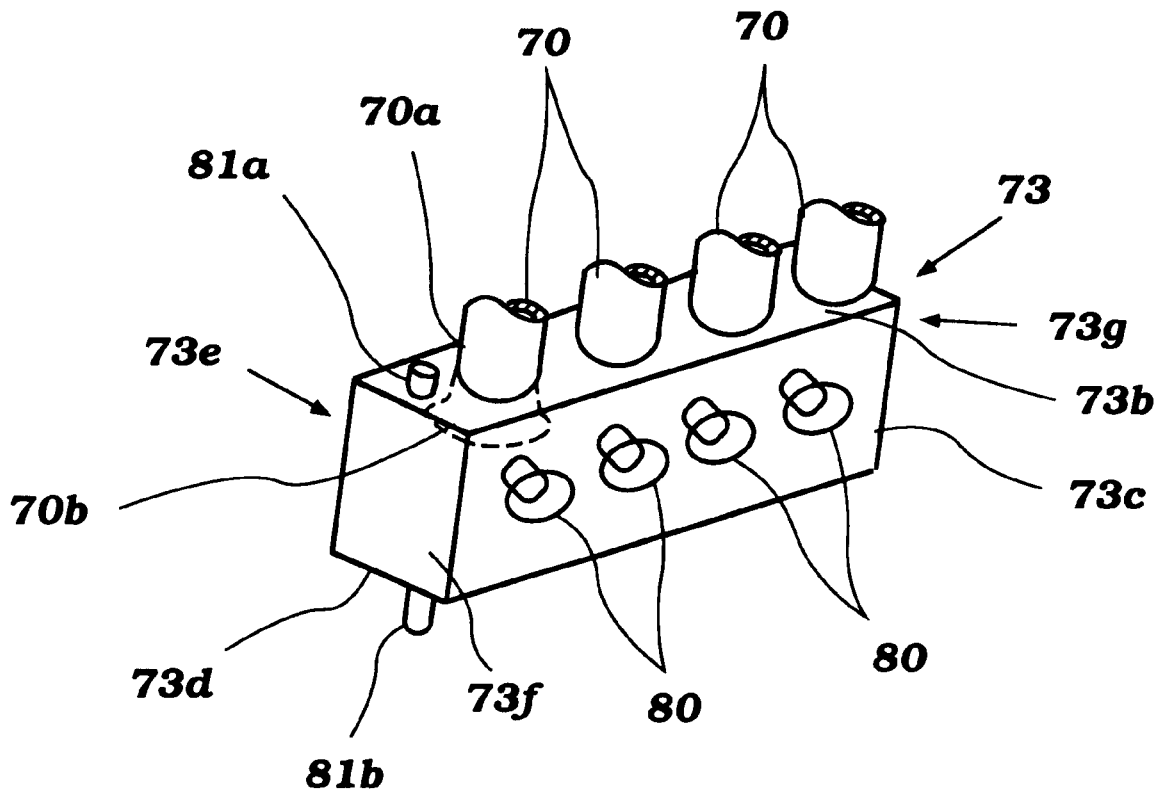
FIG. 8 is a side, perspective view of an intake merging box constructed in accordance with the present invention.

With reference now to FIGS. 7 and 8, depicted is a small watercraft incorporating another embodiment of an intake-air merging box constructed in accordance with the present invention. The intake-air merging box 73 is comprised of a ceiling wall 73*b*, an inner wall 73*c*, a bottom wall 73*d*, an outer wall 73*e* and two cap walls 73*f* and 73*g*, bonded together to form a watertight box. Disposed in the inner wall are trumpet-shaped intake ports 80, which allow air to be drawn into the merging box 73 at a low velocity while inhibiting entrance of water. Disposed in the ceiling and bottom walls 73*b*, 73*d* are drain holes 81*a*, 81*b*, which permit water trapped within the merging box 73 to drain into the engine compartment 13. While this embodiment of an intake-air merging box 73 is a square or rectangular box, it should be noted that various other shaped boxes may be used with equal utility.

As can best be seen from FIG. 7, air-intake pipes 70 connect the carburetors to the intake-air merging box 73. These air-intake pipes are comprised of upstream parts 70*a*, located adjacent to the carburetors, and expanding parts 70*b*, located within the intake air merging box 73. The trumpet-shaped design of the expanding parts 70*b* allows air to be drawn into the air-intake pipes at low velocity while inhibiting water from being drawn into the air-intake pipes.

Figure 9:
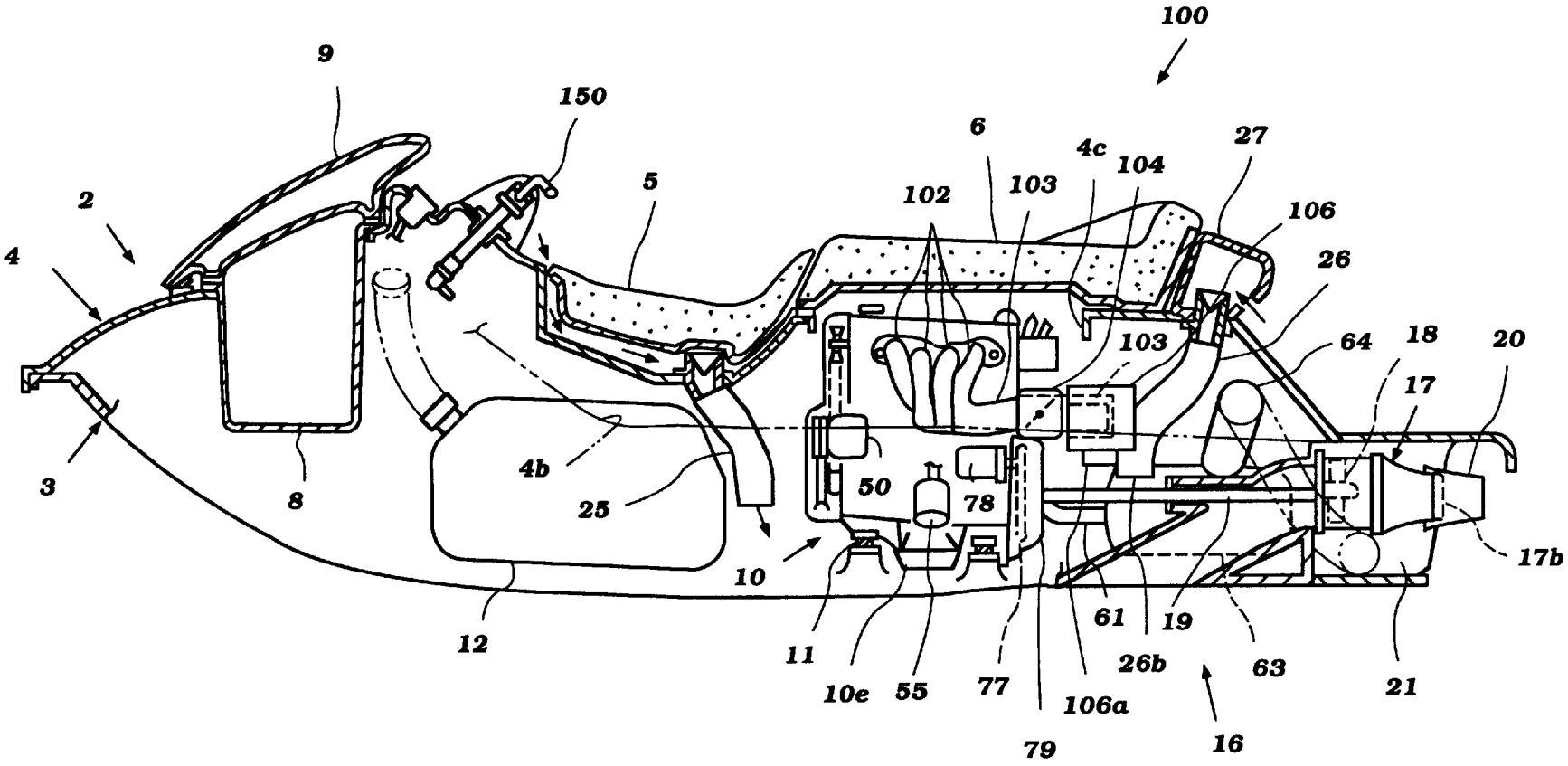
FIG. 9 is a sectional side elevational view of a small watercraft incorporating an additional embodiment of the present invention.
Figure 10:
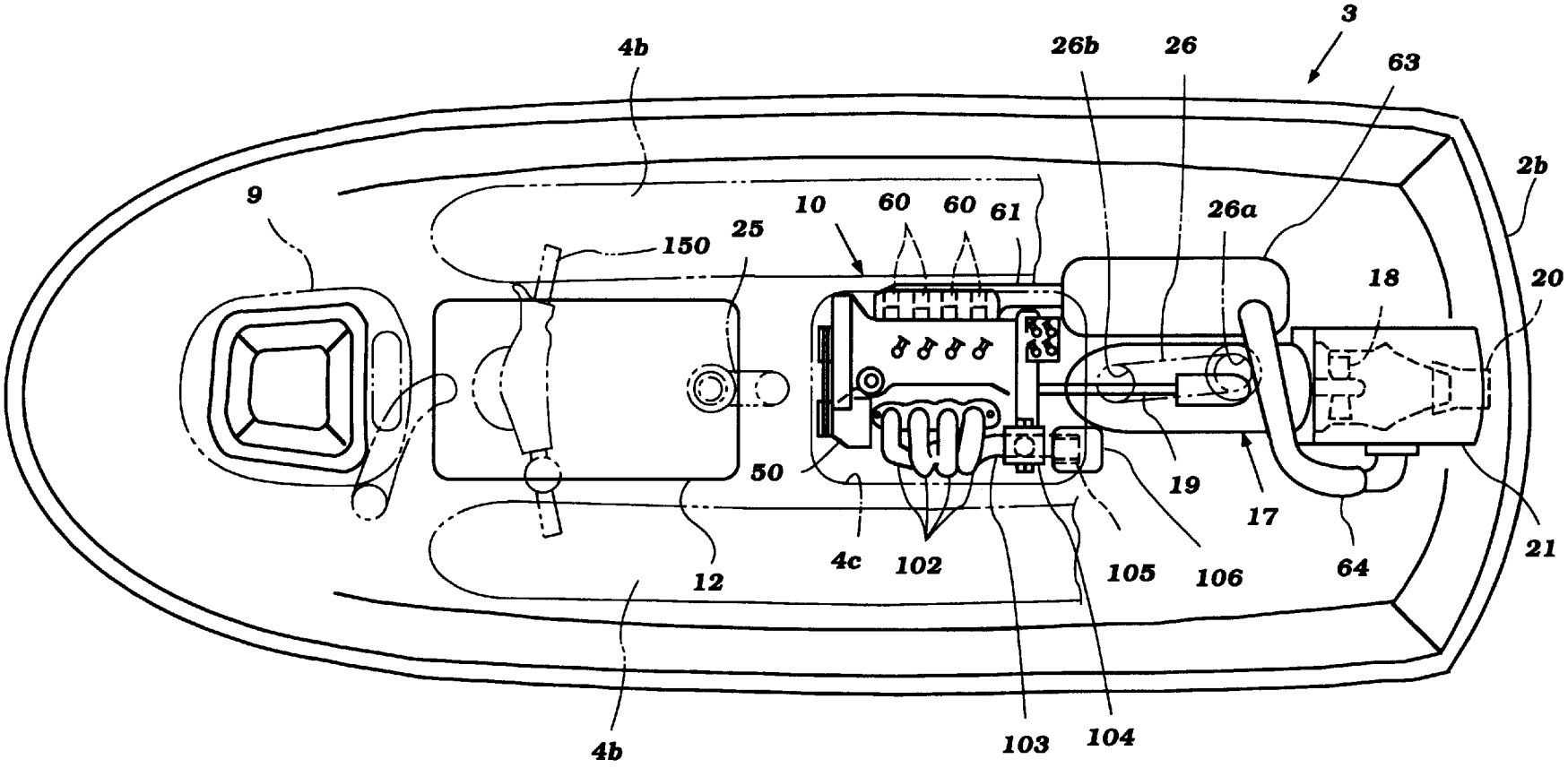
FIG. 10 is a sectional top plan view of the small watercraft of FIG. 9 and illustrates several components on the upper deck in phantom.
Figure 11:
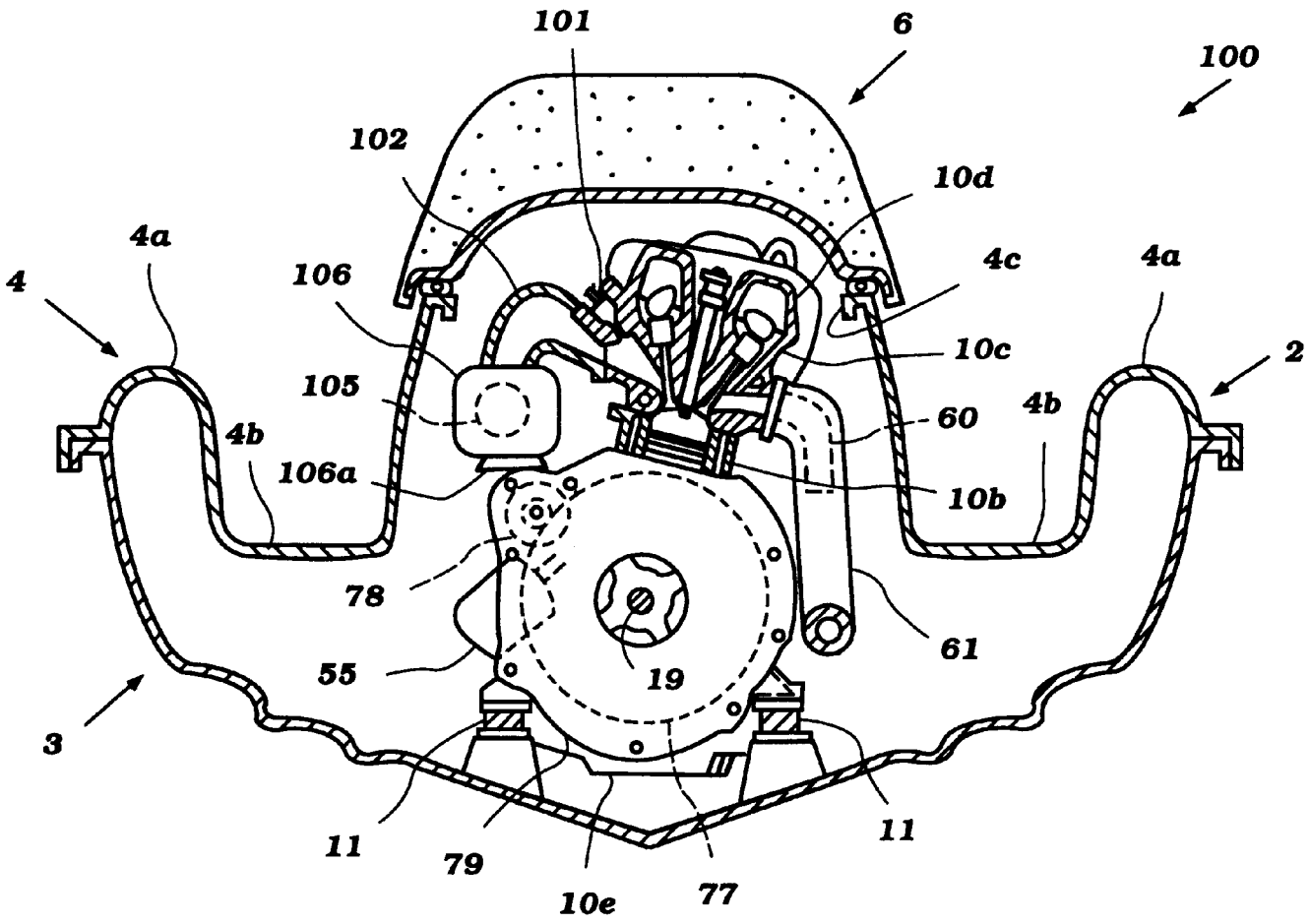
FIG. 11 is a cross-sectional rear view of the small watercraft of FIG. 9.

FIGS. 9 through 11 depict a small watercraft 100 incorporating an additional embodiment of an air intake system constructed in accordance with the present invention. In this embodiment the engine 10 utilizes a charge forming device such as a fuel injector 101 (see FIG. 11) for forming the fuel/air mixture utilized in the engine 10. Air is supplied to the engine through a number of intake pipes 102 connected to the engine 10. The opposite ends of the intake pipes 102 are connected to an intake-air merging pipe 103, which is in turn connected to a throttle body 104. The throttle body 104 is connected to the intake box 106, and an air filter 105 is disposed within the intake box 106 to clean and filter air passing into the engine 10. An intake opening 106*a* is located on the bottom surface of the intake box 106.

In operation, the air intake system of the small watercraft of FIGS. 9 through 11 will draw air into the intake opening 106*a*, through the filter 105, through the throttle body 104, and into the air merging pipe 103. Air in the air merging pipe will subsequently be drawn into and through the intake pipes 102 and into the engine 10 where it will be mixed with fuel sprayed from one or more fuel injectors 101.

As seen from FIGS. 9 and 10, the intake box 106 is positioned behind the flywheel casing 79 and to one side of the longitudinal axis opposite the side on which the water trap 63 is located. At this location, the inlet 106*a* of the intake box 106 is located next to the lower end of the rear intake duct 26. At this location, fresh air can enter the intake box while experiencing minimal heating. In addition, the flywheel casing 79 generally insulates the intake box from the engine so as to reduce the heating effect of the intake air from the intake duct 26 into the intake box 106, as well as to inhibit air flow from the front intake duct 25 across the engine 10 to the intake box 106. Consequently, the induction system intakes less air heated by the engine and more fresh air flowing through the rear intake duct 26.

In addition, the coupling between the impeller shaft 19 and the output shaft of the engine 10 is enclosed within the casing 79. As a result, the rotating components within the engine compartment tend to splatter less water about the engine compartment.

Figure 12:
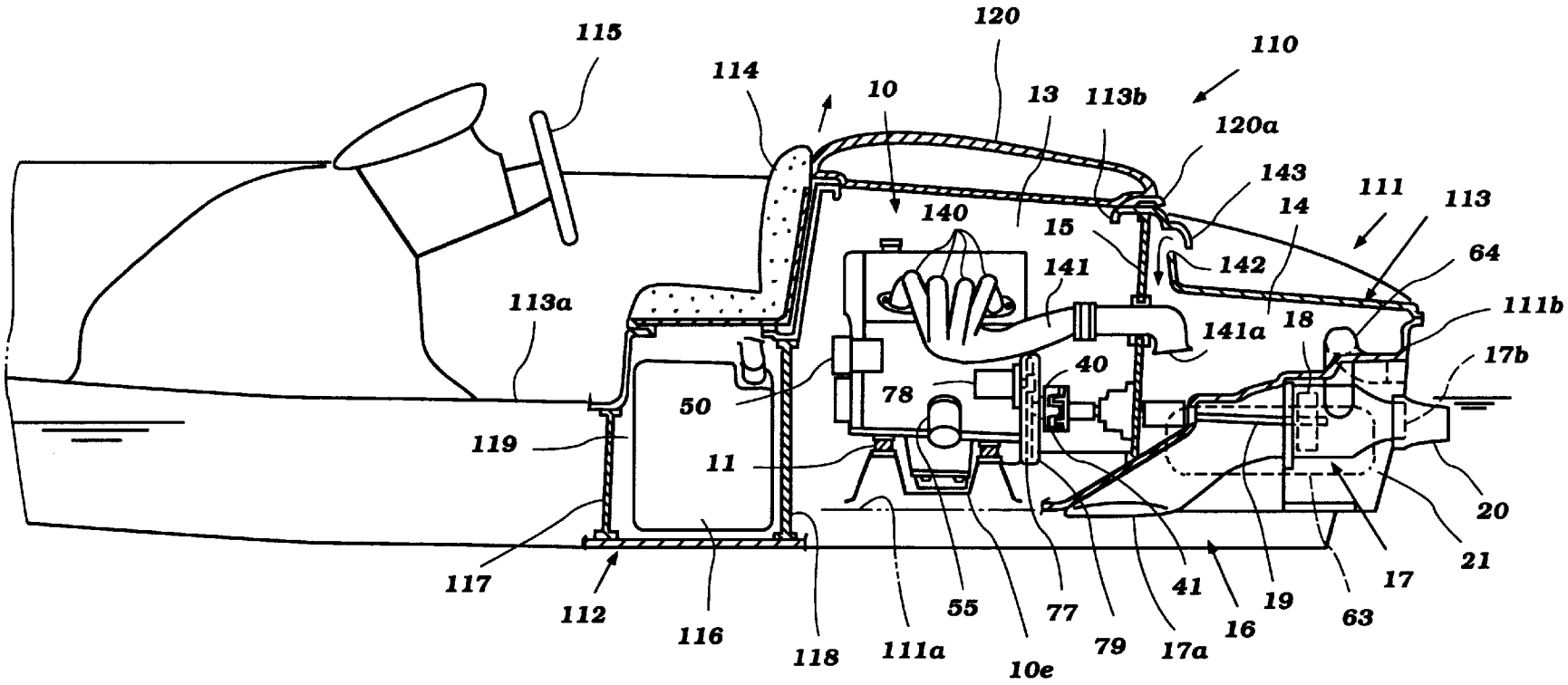
FIG. 12 is a partial sectional side view of a small watercraft incorporating another embodiment of the present invention.
Figure 13:
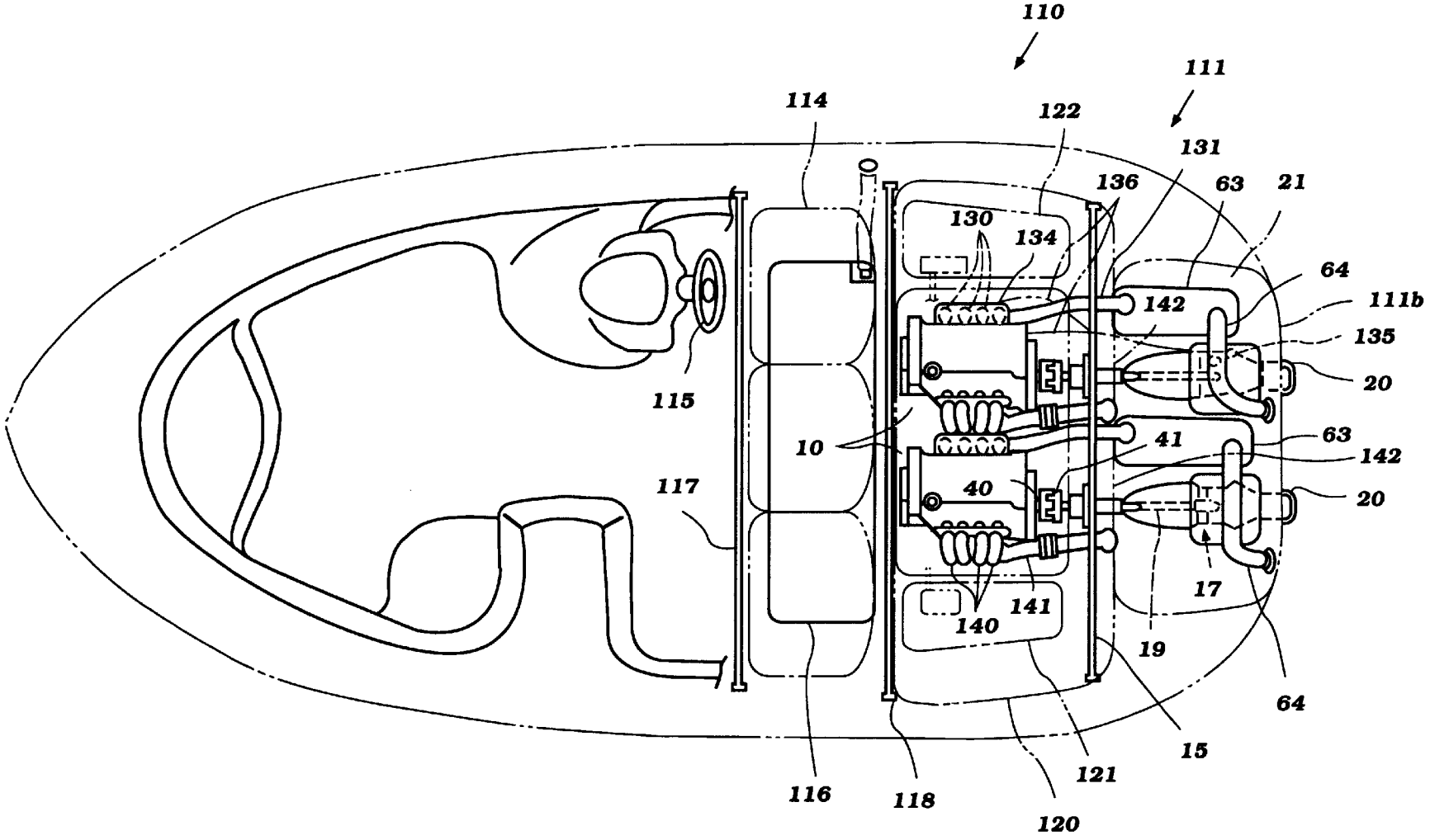
FIG. 13 is a partial sectional top plan view of the small watercraft of FIG. 12.
Figure 14:
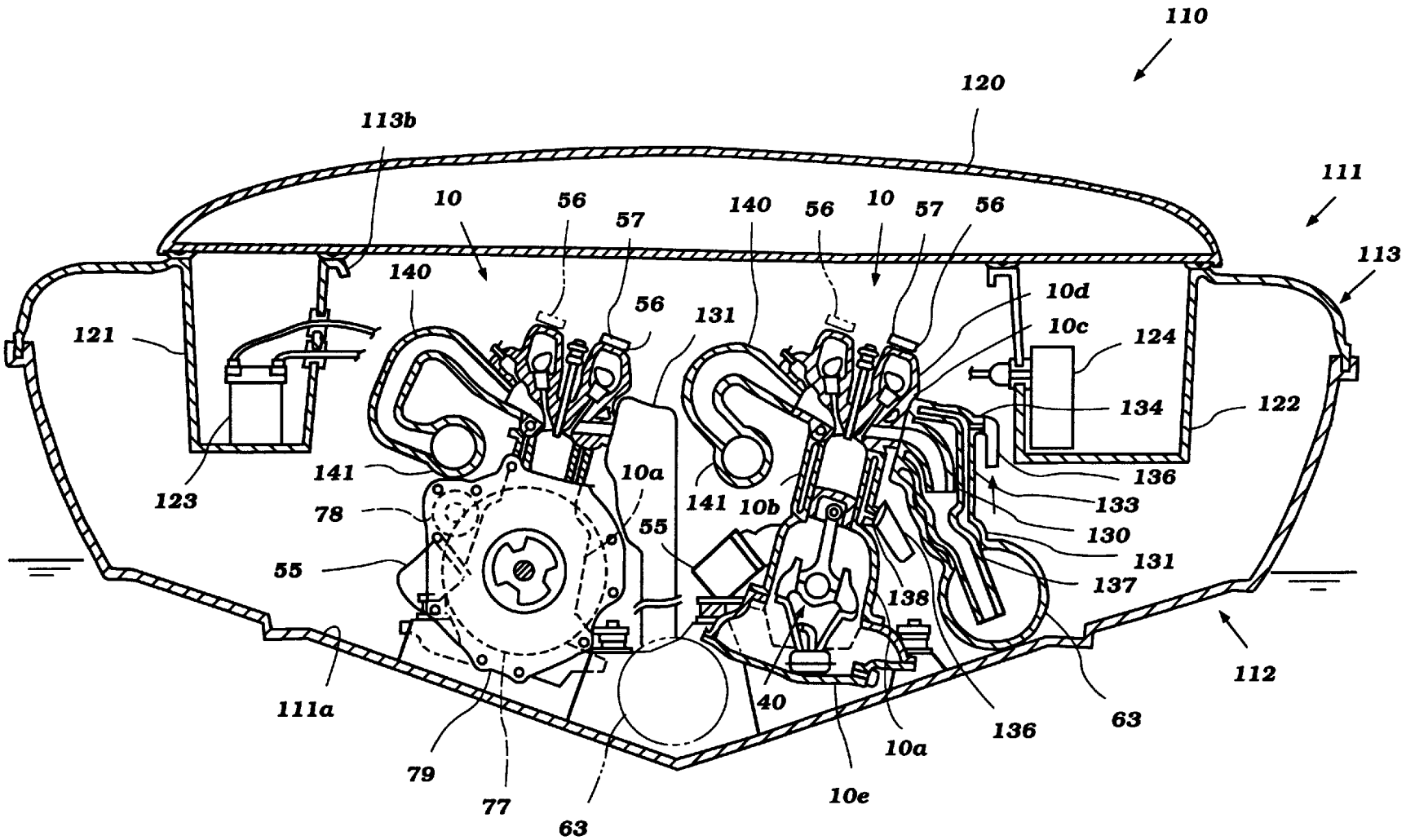
FIG. 14 is a cross-sectional rear view of the small watercraft of FIG. 12.

Turning now to FIGS. 12 through 14, there is depicted a small watercraft or jet boat 110, incorporating another embodiment of an air intake system constructed in accordance with the present invention. As viewed from the bow to the stern, the hull 112 of the jet boat 110 includes floor 113*a* and a bench-type seat 114 located forward of an aft end 111 of the watercraft. A steering handle is positioned forward of the bench-type seat, and controls the steering of the watercraft in a conventional manner well known to those skilled in the art. A deck section 113 is fixed to the hull 112 around the peripheral edges in a manner well known to those skilled in the art. As can best be seen from FIG. 14, the engines 10 are skewed by approximately 10 degrees from vertical.

A maintenance opening 113*b* is provided in the deck section 113 to provide access to the engine chamber 13. An engine hatch 120, attached to the deck by a rear hinge 120*a*, closes the maintenance opening 113*b* in a watertight manner. Two storage boxes 121, 122 are positioned in the engine chamber A storage chamber 119, located underneath the bench-type seat 114, is formed between front dividing wall 117 and rear dividing wall 118, and contains a fuel tank 116. Two storage boxes 121, 122, are located within the engine chamber 13 and are disposed alongside the outer side of each engine 10. A battery 123 is positioned within one of the storage boxes 121. Electrical engine control components 124 well known to those skilled in the art, such as computer control circuits, are located in the opposite storage box 122.

On one side of each engine 10 an exhaust system is provided. In this exhaust system, exhaust pipes 130 extend from the side of the engines and downward into an exhaust-air merging pipe 131. The exhaust-air merging pipe extends rearwardly and connects to a front end of a water lock or trap 63. The water lock 63 inhibits a reverse flow of water toward the engine. In the rear end of the water lock 63, a through-hull exhaust pipe 64 is connected. This exhaust pipe 64 extends upwardly and across the hull and over the pump chamber, and is connected to a pump chamber of the watercraft to exhaust at this location.

In the embodiment depicted in FIGS. 12 through 14, the engines 10 are cooled by a liquid cooling system comprising water jackets 133, coolant inlet ports 134, water ports 135, coolant hoses 136, and coolant drain ports 137. In operation, cooling water is pumped into the water ports 135 and travels through the cooling hoses into coolant inlet ports 134. This flow of cooling water travels into the water jackets 133, and comes in contact with the cylinder block 10*b*, the cylinder heads 10*c*, and the engine exhaust pipe 130. The cooling water than travels into the exhaust pipe, travels through the water lock 63, and is discharged out of the jet boat through the through-hull exhaust pipe 64.

The intake air system comprises intake pipes 140 connected to air inlets of the engines 10. The opposite ends of these intake pipes 140 are connected to an intake air merging pipe 141. The intake air merging pipe extends rearwardly and through the bulkhead 15, and connects to an intake air port 141*a* which is open to the propulsion chamber 14. An air inlet port 142 is provided in the upper deck 113 which allows outside air to travel into the propulsion chamber 14. A cover 143, located over the air inlet port 142, prevents water from entering the propulsion chamber.

Figure 15:
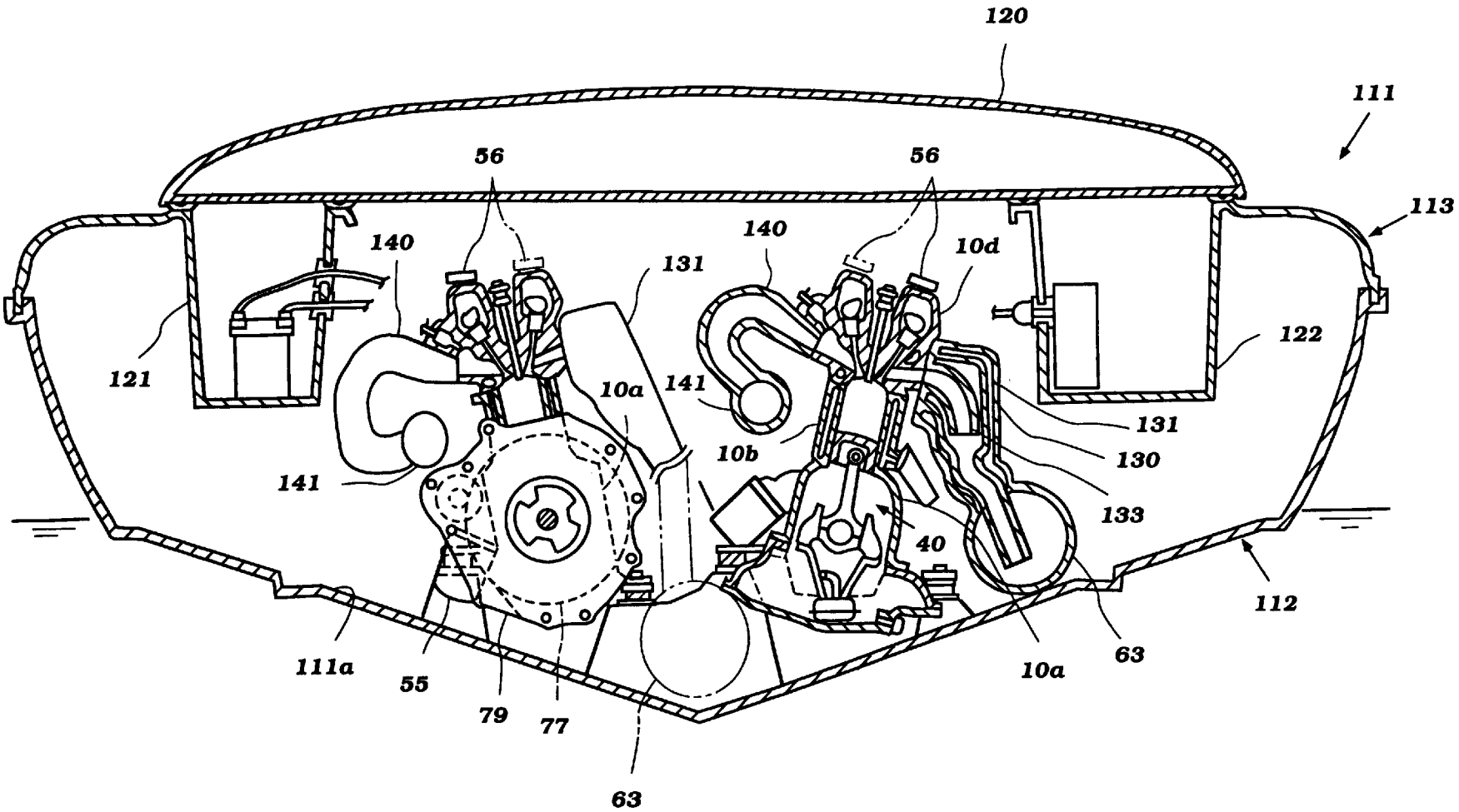
FIG. 15 is a cross-sectional rear view of a small watercraft incorporating an additional embodiment of the present invention.

FIG. 15 depicts the jet boat of FIGS. 12 through 14, incorporating an additional embodiment of the present invention. In this embodiment, the engines 10 are positioned such that the cylinders of the engines 10 are skewed by approximately 10 degrees left and right, respectively, from vertical, thus forming a V-shape. This embodiment provides for increased separation between the engines, facilitating maintenance and removal of the engines, if required. The increased spacing between the exhaust system of one engine and the induction system of the other engine will further reduce the temperature of the air used to form the fuel/air charge.

Accordingly, although this invention has been described in terms of certain preferred embodiments, other embodiments apparent to those of ordinary skill in the art are also within the scope of this invention. Of course, a watercraft need not include all of these features to appreciate some of the aforementioned advantages associated with the present watercraft. Accordingly, the scope of the invention is intended to be defined only by the claims that follow.

What is claimed is:

1. A small watercraft is comprised of a hull having a longitudinal axis and an engine compartment containing an engine, the engine including a plurality of cylinders and an output shaft arranged to lie generally parallel to the longitudinal axis, a flywheel carried by the output shaft on a rear side of the engine and generally covered by a flywheel casing, an impeller shaft coupled to said output shaft, an air intake system connected to the engine and communicating with each cylinder of the engine through intake passages in the engine, and an exhaust system connected to the engine and communicating with each cylinder of the engine through exhaust passages in the engine, the exhaust system extending from the engine exhaust passages to a discharge end that opens outside of the engine compartment, the exhaust system including a water lock located at least in part behind the engine with at least a portion of the flywheel casing being arranged between at least a portion of the water lock and at least a portion of the air intake system.

2. The small watercraft as in claim 1, wherein the air intake system includes a downwardly-facing opening that communicates with an intake air silencer.

3. The small watercraft as in claim 1, wherein said engine is oriented within the engine compartment such that axes of the engine cylinders are skewed from a vertical plane that contains the longitudinal axis.

4. The small watercraft as in claim 3, wherein each intake passages of said engine slope downward toward a respective cylinder of said engine.

5. The small watercraft as in claim 1 wherein said hull includes a rider's area comprising a longitudinally extending, straddle-type seat located above the engine, and a pair of foot areas that extend along both sides of the seat.

6. The small watercraft of claim 1, wherein said air intake system includes an intake opening located forward of said flywheel casing, and a coupling, which interconnects said engine output shaft and impeller shaft, being located behind said flywheel casing.

7. The small watercraft of claim 1 additionally comprising a second engine with plural cylinders, said engines being mounted parallel to each other, each of said engines being oriented within the engine compartment such that axes of the engine cylinders are skewed from a vertical plane that contains the longitudinal axis.

8. The small watercraft of claim 7, wherein the cylinder axes of the first engine and the cylinder axes of the second engine are not parallel.

9. The small watercraft of claim 8, wherein the cylinder axes of the first engine slope downward generally toward the longitudinal axis and the cylinder axes of the second engine also slope downward generally toward the longitudinal axis so as to arrange the engines in generally a V-configuration.

10. A small watercraft is comprised of a hull having a longitudinal axis and an engine compartment containing an engine, the engine including a plurality of cylinders and an output shaft arranged to lie generally parallel to the longitudinal axis, a flywheel carried by the output shaft on a rear side of the engine and generally covered by a flywheel casing, an impeller shaft coupled to the output shaft, an air intake system connected to the engine and communicating with each cylinder of the engine through intake passages in the engine, and an exhaust system connected to the engine and communicating with each cylinder of the engine through exhaust passages in the engine, said exhaust system extending from the engine exhaust passages to a discharge end that opens outside of the engine compartment, the exhaust system including a water lock located at least in part behind the engine with at least a portion of the flywheel casing being arranged between at least a portion of the water lock and at least a portion of the air intake system, the air intake system including a downwardly-facing opening that communicates with an intake air silencer, the air intake system further including a plurality of intake pipes that lie between the intake air silencer and the intake passages of the engine, the intake pipes being bent downward toward the intake air silencer.

11. A small watercraft is comprised of a hull having a longitudinal axis and an engine compartment containing an engine, the engine including a plurality of cylinders and an output shaft arranged to lie generally parallel to the longitudinal axis, a flywheel carried by the output shaft on a rear side of the engine and generally covered by a flywheel casing, an impeller shaft coupled to the output shaft, an air intake system connected to one side of the engine and communicating with each cylinder of the engine through intake passages in the engine, and an exhaust system connected to the engine and communicating with each cylinder of the engine through exhaust passages in the engine, said exhaust system extending from the engine exhaust passages to a discharge end that opens outside of the engine compartment, the exhaust system including a water lock located at least in part behind the engine with at least a portion of the flywheel casing being arranged between at least a portion of the water lock and at least a portion of the air intake system, the air intake system including a downwardly-facing opening that communicates with an intake air silencer, the air intake system additionally including an intake air box into which the air flows from the downwardly-facing opening, and from which air flows into the intake air silencer.

12. A small watercraft is comprised of a hull having a longitudinal axis and an engine compartment containing an engine, the engine including a plurality of cylinders and an output shaft arranged to lie generally parallel to the longitudinal axis, a flywheel carried by the output shaft on a rear side of the engine and generally covered by a flywheel casing, an impeller shaft coupled to the output shaft, an air intake system connected to the engine and communicating with each cylinder of the engine through intake passages in the engine, an exhaust system connected to the engine and communicating with each cylinder of the engine through exhaust passages in the engine, said exhaust system extending from the engine exhaust passages to a discharge end that opens outside of the engine compartment, the exhaust system including a water lock located at least in part behind the engine with at least a portion of the flywheel casing being arranged between at least a portion the water lock and at least a portion of the air intake system, and an air duct to guide ambient air into the engine compartment of the watercraft, the air duct having an opening located below an intake opening of the intake air system.

13. A small watercraft is comprised of a hull having a longitudinal axis and an engine compartment containing an engine, the engine including a plurality of cylinders and an output shaft arranged to lie generally parallel to the longitudinal axis, a flywheel carried by the output shaft on a rear side of the engine and generally covered by a flywheel casing, an impeller shaft coupled to the output shaft, an air intake system connected to the engine and communicating with each cylinder of the engine through intake passages in said engine, an exhaust system connected to the engine and communicating with each cylinder of the engine through exhaust passages in the engine, the exhaust system extending from said engine exhaust passages to a discharge end that opens outside of the engine compartment, the exhaust system including a water lock located at least in part behind the engine with at least a portion of the flywheel casing being arranged between at least a portion of the water lock and at least a portion of the air intake system, and a bulkhead which separates said engine compartment from a propulsion chamber located behind the engine compartment near a stem of the watercraft, the bulkhead being located proximate a coupling between the engine output shaft and the impeller shaft, and an air inlet port disposed above the engine compartment and communicating with an air duct, the air duct extending through the bulkhead and opening into the propulsion chamber.

14. A small watercraft is comprised of a hull having a longitudinal axis and an engine compartment containing an engine, the engine including a plurality of cylinders and an output shaft arranged to lie generally parallel to the longitudinal axis, a flywheel carried by the output shaft on a rear side of the engine and generally covered by a flywheel casing, an impeller shaft coupled to the output shaft, an air intake system connected to the engine and communicating with each cylinder of the engine through intake passages in the engine, an exhaust system connected to the engine and communicating with each cylinder of the engine through exhaust passages in the engine, the exhaust system extending from the engine exhaust passages to a discharge end that opens outside of the engine compartment, said exhaust system including a water lock located at least in part behind the engine with at least a portion of the flywheel casing being arranged between at least a portion of the water lock and at least a portion of the air intake system, and an air duct which extends into the engine compartment to introduce ambient air into the engine compartment, the air duct including a lower opening which is positioned next to an air inlet opening of the intake air system.

15. The small watercraft as in claim 14, wherein said air duct includes a normally-open valve.

16. A small watercraft is comprised of a hull having a longitudinal axis and an engine compartment containing an engine, the engine including a plurality of cylinders and an output shaft arranged to lie generally parallel to the longitudinal axis, a flywheel carried by the output shaft on a rear side of the engine and generally covered by a flywheel casing, an impeller shaft coupled to the output shaft, an air intake system connected to the engine and communicating with each cylinder of the engine through intake passages in the engine, and an exhaust system connected to the engine and communicating with each cylinder of the engine through exhaust passages in the engine, the exhaust system extending from the engine exhaust passages to a discharge end that opens outside of the engine compartment, the exhaust system including a water lock located at least in part behind the engine with at least a portion of the flywheel casing being arranged between at least a portion of the water lock and at least a portion of the air intake system, the air intake system including a plurality of intake pipes that extend between an intake air silencer and the intake passages of the engine, the intake pipes being bent downward toward the intake air silencer.

17. A small watercraft comprised of a hull defining an engine compartment between fore and aft ends of the hull, an internal combustion engine positioned within the engine compartment, the engine including at least one combustion chamber, at least one intake passage which selectively communicates with the at least one combustion chamber, at least one exhaust passage which selectively communicates with the at least one combustion chamber, and a plurality of valves that regulate fluid flow through the intake and exhaust passages, and an induction system connected to an influent end of the intake passage, the induction system being arranged within the engine compartment such that an inlet to the induction system is positioned lower than the influent end of the intake passage of the engine.

18. A small watercraft as in claim 17 additionally comprising at least one air duct that extends through the hull into the engine compartment, and the inlet to the induction system is positioned higher than an outlet end of the air duct within the engine compartment.

19. A small watercraft as in claim 18, wherein the air duct is arranged in front of the engine.

20. A small watercraft as in claim 19, wherein at least a portion of the outlet end of the air duct lies forward of the inlet to the induction system.

21. A small watercraft as in claim 18 additionally comprising a second air duct that extends through the hull into the engine compartment, a second air duct being positioned at one end of the engine and the first air duct being positioned at an opposite end of the engine with at least a portion of the engine located between the outlet end of the air ducts.

22. A small watercraft as in claim 17, wherein the inlet to the induction system includes a downwardly facing opening.

23. A small watercraft as in claim 17, wherein the engine includes at least one cylinder that forms at least a portion of the at least combustion chamber, and the cylinder is arranged within the engine compartment in an inclined manner relative to a vertical plane that extends longitudinally between the fore and aft ends of the watercraft.

24. A small watercraft as in claim 17 additionally comprising an exhaust system connected to the engine and communicating at least with the one combustion chamber of the engine through the exhaust passage.

25. A small watercraft as in claim 24, wherein the induction system is attached to one side of the engine and the exhaust system is attached to the other side of the engine, the exhaust system extending from the engine along a side of the engine which is opposite to the side on which the induction system is attached and to a discharge end that opens outside the engine compartment.

26. A small watercraft comprising a hull defining an engine compartment, a four-cycle internal combustion engine positioned within the engine compartment, the engine including at least one combustion chamber, at least one intake passage which selectively communicates with the combustion chamber, and an induction system connected to an intake port on the engine that communicates with the intake passage, the induction system including at least one intake pipe that is bent downward toward an intake silencer and communicates with a plenum chamber within the intake silencer, the intake silencer including an inlet opening and a drain hole, the drain hole being provided on a lower portion of the intake silencer, the inlet opening being arranged on the intake silencer at a position higher than the drain hole.

27. The small watercraft as in claim 26, wherein the intake pipe extends through an upper portion of the intake silencer and protrudes downwardly into the plenum chamber.

28. A small watercraft as in claim 26, wherein the inlet opening is formed on the upper portion of the intake silencer.

29. A small watercraft as in claim 26, wherein the inlet opening is arranged on the lower portion of the air silencer.

* * * * *